US009352457B2

(12) United States Patent
MacFarlane

(10) Patent No.: US 9,352,457 B2
(45) Date of Patent: May 31, 2016

(54) WRENCH STABILIZING SYSTEM

(71) Applicant: Robert Scott MacFarlane, Nepean (CA)

(72) Inventor: Robert Scott MacFarlane, Nepean (CA)

( * ) Notice: Subject to any disclaimer, the term of this patent is extended or adjusted under 35 U.S.C. 154(b) by 288 days.

(21) Appl. No.: 13/902,530

(22) Filed: May 24, 2013

(65) Prior Publication Data

US 2013/0312578 A1 Nov. 28, 2013

(30) Foreign Application Priority Data

May 24, 2012 (CA) ..... 2778020

(51) Int. Cl.
*B25B 23/00* (2006.01)
*B25B 13/00* (2006.01)

(52) U.S. Cl.
CPC ..... *B25B 23/00* (2013.01); *B25B 13/00* (2013.01)

(58) Field of Classification Search
CPC ..... B25B 11/00; B25B 11/02; B25B 23/00; B25B 23/0007; B25B 13/00; B25B 13/12; B25B 13/48; B25B 13/5041; B25B 13/5058; B25B 5/006
USPC ..... 81/462, 184
See application file for complete search history.

(56) References Cited

U.S. PATENT DOCUMENTS

| | | | | | |
|---|---|---|---|---|---|
| 214,697 | A * | 4/1879 | Peppier | 81/184 | |
| 439,918 | A * | 11/1890 | Wilkes | B25B 5/006 81/180.1 | |
| 770,058 | A * | 9/1904 | Foster | A01K 97/28 269/4 | |
| 2,637,235 | A * | 5/1953 | Licari | 81/180.1 | |
| 3,320,836 | A * | 5/1967 | Hagerman | 81/180.1 | |
| 5,791,213 | A * | 8/1998 | Young | 81/462 | |
| 6,523,818 | B1 | 2/2003 | Le Vert et al. | | |

* cited by examiner

*Primary Examiner* — Hadi Shakeri
(74) *Attorney, Agent, or Firm* — Edwin S. Flores; Daniel J. Chalker; Chalker Flores, LLP

(57) ABSTRACT

A wrench stabilizing system, wherein the wrench has an insertion opening machined on an exterior surface of the wrench head which extends throughout a length of the wrench head. A stabilizing portion is inserted through the insertion opening on the wrench head, and effectively stabilizes and supports a wrench in a use position and prevents rotation of the pipe being worked on, while at the same time, enabling a worker to operate another wrench in the process.

10 Claims, 4 Drawing Sheets

WRENCH STABILIZING SYSTEM

The present invention relates to a wrench stabilizing system, and more particularly, to a pipe wrench stabilizing system for stabilizing the pipe wrench or other hand tool on a surface.

BACKGROUND OF THE INVENTION

It is known that plumbers and pipe fitters assemble threaded pipe using large wrenches such as pipe wrenches. Such connections usually require one part of piece to be rotated relative to another connectable component. It is not uncommon for a plumber, mechanic or pipe fitter in such a situation to operate two wrenches simultaneously in different rotational directions, in that, in order to adequately tighten a coupling on a threaded pipe end, a pair of pipe wrenches are often required to be used. However, it is not uncommon in this situation that the wrench used for clamping the pipe is placed on the floor and held in an unstable, upward facing position by a worker's hand or foot. While the pipe wrench is in this unstable position, it can slip or tip over, possibly resulting in injury. In addition, each time a pipe wrench tips over, it must be set up again to clamp the pipe and continue the process, which can be tedious and time consuming.

It would therefore be advantageous to have an improved wrench stabilizing system which is able to effectively stabilize and support a wrench in a use position and prevent rotation of the pipe being worked on.

It would be further advantageous to have an improved wrench stabilizing system which is able to effectively stabilize and support one wrench in a use position and prevent rotation of the pipe being worked on, while at the same time, enabling a worker to operate another wrench in the process. To this end, the present invention effectively addresses this need.

SUMMARY OF THE INVENTION

The present invention provides an improved wrench stabilizing system which is able to effectively stabilize and support a wrench in a use position and prevent rotation of the pipe being worked on, while at the same time, enabling a worker to operate another wrench in the process.

The present invention provides an improved wrench stabilizing system which utilizes a stabilizing piece which is inserted and accepted through an insertion opening cast or machined into the wrench head.

According to a first broad aspect of the present invention, there is provided a wrench stabilizing system comprising a wrench having a handle with a fixed portion and a movable portion, the movable portion being rotatable about an axis through the handle and wherein an upper end of the handle forms a wrench head; a first clamping portion mounted to the handle; a second clamping portion mounted to the movable portion, rotation of the movable portion causing relative movement between the first clamping portion and the second clamping portion toward or away from one another; an insertion opening on an exterior surface of the wrench head; a wrench stabilizing portion for supporting the wrench in a use position, the wrench stabilizing portion being constructed and arranged for insertion through the insertion opening of the wrench and comprising a base portion having an upper surface and a lower surface; a connection portion attached to the base portion and projecting upwardly from the upper surface, the upstanding connection portion extending longitudinally relative to the base portion; and an abutment portion attached to the base portion and projecting upwardly from the upper surface, the upstanding connection portion extending laterally across an end of the base portion.

According to a further broad aspect of the present invention, there is provided a wrench comprising a handle with a fixed portion and a movable portion, the movable portion being rotatable about an axis through the handle and wherein an upper end of the handle forms a wrench head; a first clamping portion mounted to the handle; a second clamping portion mounted to the movable portion, rotation of the movable portion causing relative movement between the first clamping portion and the second clamping portion toward or away from one another; and an insertion opening on an exterior surface of the wrench head, the insertion opening being constructed and arranged for receiving an insertion of a stabilizing piece through the insertion opening to stabilize the wrench in a use position.

BRIEF DESCRIPTION OF THE DRAWINGS

The embodiments of the present invention will now be described by reference to the following figures, in which identical reference numerals in different figures indicate identical elements and in which.

DETAILED DESCRIPTION OF THE INVENTION

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

Figure 1:
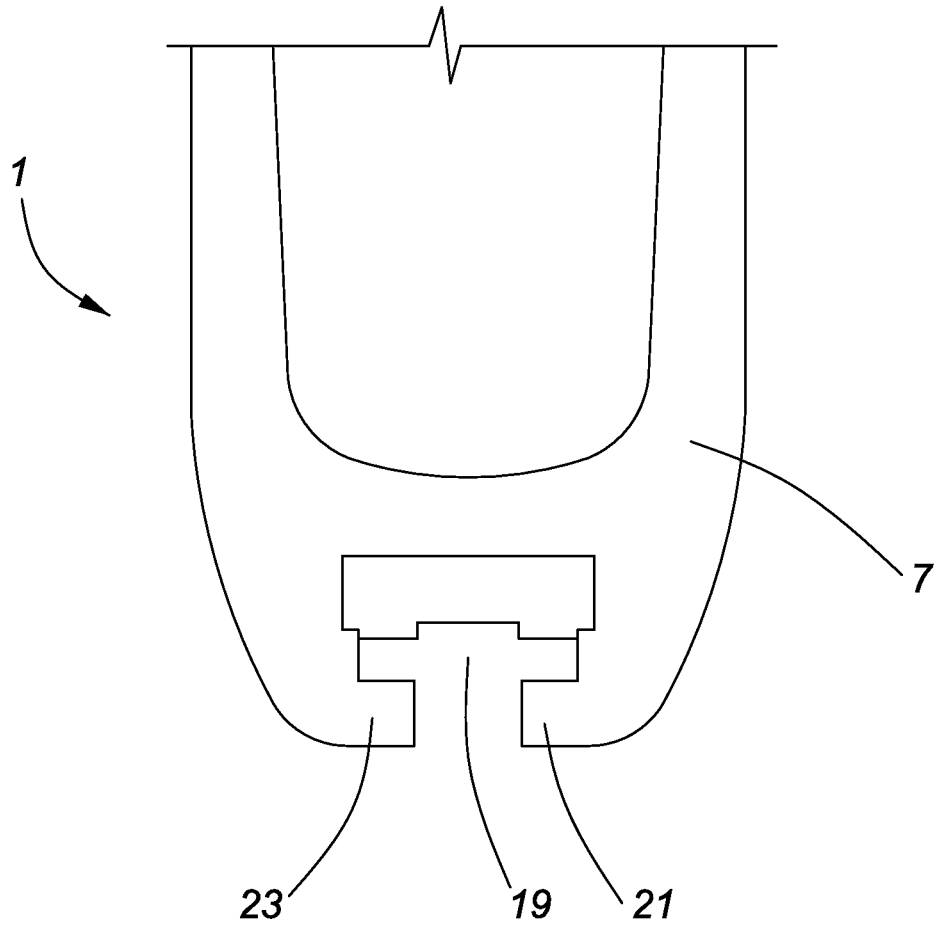
FIG. 1 is an end view of an embodiment of the wrench head of the wrench, and illustrating the insertion opening therein.
Figure 2:
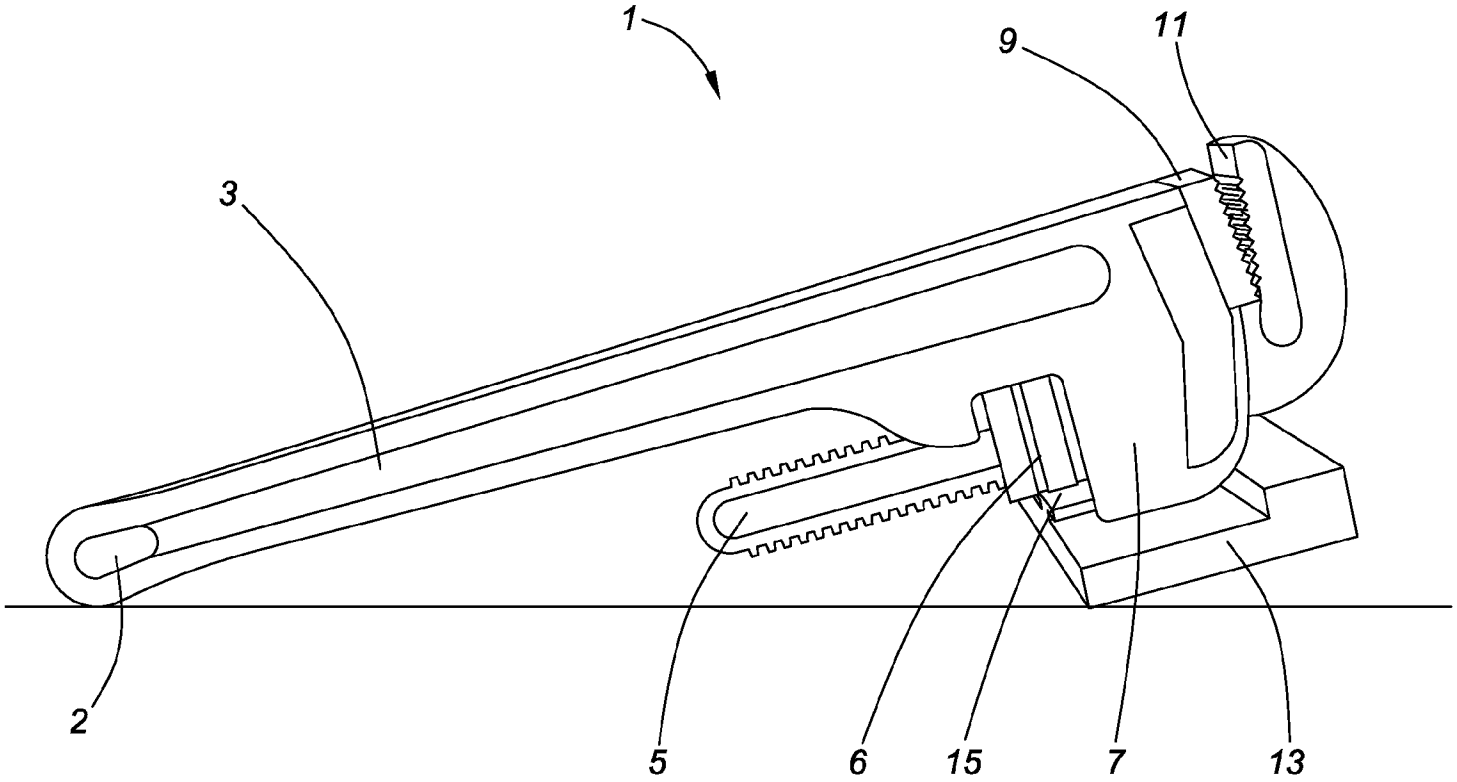
FIG. 2 is a side view of an embodiment of the present invention, and illustrating the wrench stabilizing portion having been inserted through the insertion opening of the wrench and supporting the wrench in a use position.

Referring to FIGS. 1 and 2, a first exemplary embodiment of the wrench stabilizing system 1 of the present invention is shown. As can be seen, the system comprises a wrench 3 having a handle 2 (a fixed portion) and a movable portion 5, the movable portion 5 being slidable (adjustable) by means of an adjustment wheel 6 through the handle 2. Of course, an upper end of the handle 2 forms the wrench head 7. A first clamping portion 9 is mounted to the upper end of the handle 2, and a second clamping portion 11 is mounted to the movable portion 5, rotation of the adjustment wheel 6 results in the sliding of movable portion 5 of the handle causing relative movement between the first clamping portion 9 and the second clamping portion 11 toward or away from one another.

As can be seen in FIG. 1, an insertion opening 19 is machined on an exterior surface of the wrench head 7, and extends throughout a length of the wrench head 7. In a preferred embodiment, the opening 19 will be at least partially covered by lip portions 21 and 23, whereby the opening 19, as shown in FIG. 1, resembles a T-Shaped opening. Of course, persons skilled in the art will understand that variations to this could be effected.

Figure 3:
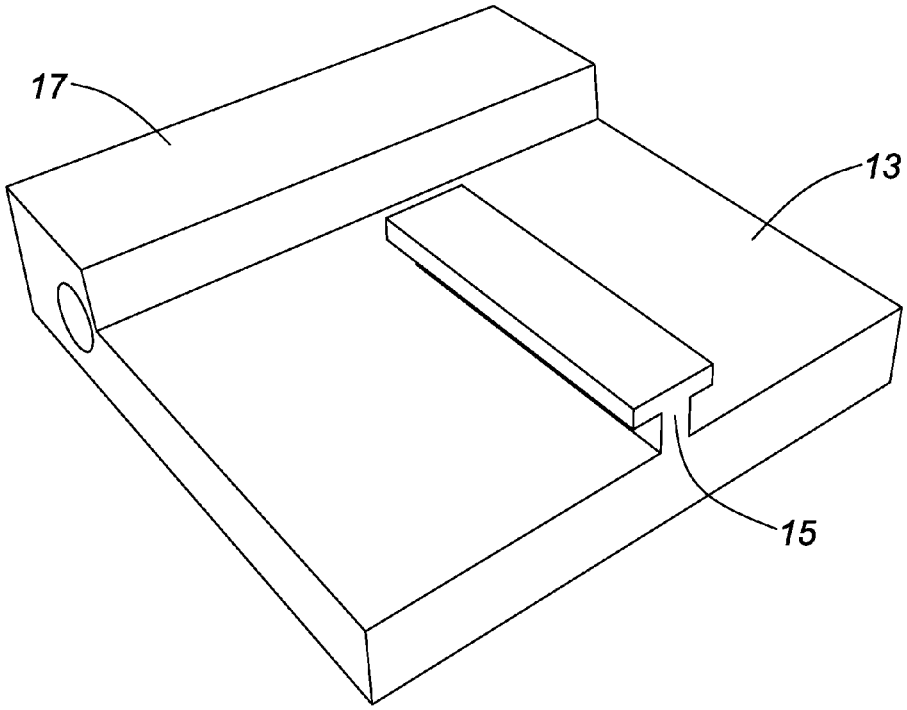
FIG. 3 is a perspective view of an embodiment of the wrench stabilizing portion for supporting the wrench in a use position, the wrench stabilizing portion being constructed and arranged for insertion through the insertion opening of the wrench.

Preferably, to secure and stabilize the wrench 3, a stabilizing portion 13, as shown in FIGS. 2 and 3, is inserted into the insertion opening 19 on the wrench head 7. In doing so, connection portion 15, which is attached to the stabilizing portion 13 and projects upwardly from the upper surface thereof, is inserted into the insertion opening 19. Preferably, the shape of the connection portions 15 will match that of the insertion opening 19. As shown in FIG. 1, the connection portion 15 is illustrated as being T-shaped. Since the upstanding connection portion 15 extends longitudinally relative to the stabilizing portion 13, an entire length of the connection portion 15 is slid through the insertion opening 19, and is retained therein by means of lip portions 21 and 23. Once the entire length of the connection portion 15 has been slid through the insertion opening 19, further progress of the connection portion 15 within opening 19 is restricted once the wrench head 7 contacts abutment portion 17 which is also attached to the stabilizing portion 13. The abutment portion 17 also projects upwardly from the stabilizing portion 13, and, in contrast to the connection portion 15, extends laterally across an end of the stabilizing portion 13, and in transverse relationship to the connection portion 15. The fully completed insertion of the stabilizing portion 13 within insertion opening 19 can be seen in FIG. 2, which illustrates how the stabilizing portion 13 supports the wrench in a use position.

In a preferred embodiment, one end of the base of the stabilizing portion 13 will be higher than the other, whereby when the wrench 3 is being supported by the stabilizing portion 13, the wrench will be elevated at an angle, as shown in FIG. 2. This anglature could be, for example, 20 degrees, though it will be readily understood that variations to this are possible.

Figure 4:
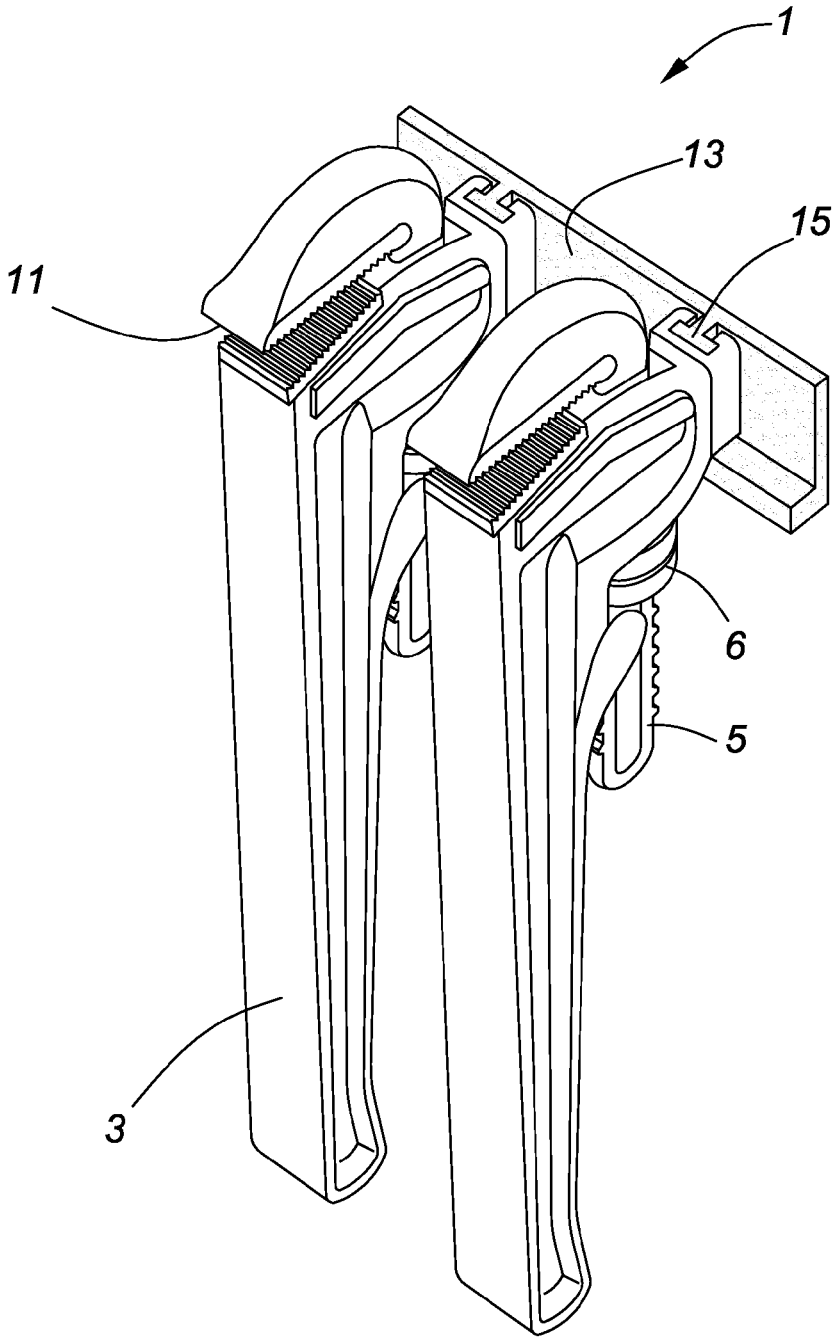
FIG. 4 is a perspective view of a further embodiment of the wrench stabilizing portion, illustrating the stabilizing portion in use as a wall mount for storage of a plurality of wrenches.

Further, in an alternative embodiment of the stabilizing portion 13, as shown in FIG. 4, the stabilizing portion 13 could also be used as a storage rack, for supporting a plurality of wrenches 3 on a wall or other surface. In this embodiment, however, each end of the base of the stabilizing portion 13 will have a similar height, so as to ensure any wrench 3 placed on the stabilizing portion 13 will assume a substantially vertical position and parallel to the wall, if the wall mount structure shown in FIG. 4 is utilized. Of course, it will also be understood that, both versions of the stabilizing portion 13 could be utilized.

Other embodiments consistent with the present invention will become apparent from consideration of the specification and the practice of the invention disclosed therein.

Accordingly, the specification and the embodiments are to be considered exemplary only, with the true scope and spirit of the invention being disclosed by the following claims.

The embodiments of the invention in which an exclusive property or privilege is claimed are defined as follows:

1. A wrench stabilizing system comprising:

a wrench having:

a handle with a fixed portion and a movable portion, the movable portion being slidable through the handle by rotation of an adjustment wheel rotatable about an axis through the handle, and wherein an upper end of the handle forms a wrench head;

a first clamping portion mounted to the handle;

a second clamping portion mounted to the movable portion, sliding of the movable portion causing relative movement between the first clamping portion and the second clamping portion toward or away from one another;

an insertion opening on an exterior surface of the wrench head; and a wrench stabilizing portion for supporting the wrench in a use position, the wrench stabilizing portion being constructed and arranged for insertion through the insertion opening of the wrench and comprising:

a base portion having an upper surface and a lower surface;

a connection portion for engagement with the insertion opening, the connection portion attached to the base portion and projecting upwardly from the upper surface, the connection portion extending longitudinally relative to the base portion; and an abutment portion for engagement with the wrench head, the abutment portion attached to the base portion and projecting upwardly from the upper surface, the abutment portion extending laterally across an end of the base portion.

2. The wrench stabilizing system of claim 1, wherein the movable portion of the handle is slidable along the axis to selectively extend the handle.

3. The wrench stabilizing system of claim 1, wherein the wrench is a pipe wrench.

4. The wrench stabilizing system of claim 1, wherein the insertion opening is a T-shaped opening.

5. The wrench stabilizing system of claim 1, wherein the connection portion is T-shaped.

6. A wrench comprising:

a handle with a fixed portion and a movable portion, the movable portion being slidable through the handle by means of rotation of an adjustment wheel rotatable about an axis through the handle, and wherein an upper end of the handle forms a wrench head having a distal end and a proximal end;

a first clamping portion mounted to the handle;

a second clamping portion mounted to the movable portion, sliding of the movable portion causing relative movement between the first clamping portion and the second clamping portion toward or away from one another; and an insertion opening on an exterior surface of the wrench head that extends through a length of the wrench head from the distal end to the proximal end, the insertion opening comprising an opening partially covered by a first and a second lip portion to form a T-shaped opening, wherein the insertion opening is open at both the distal and proximal ends, the insertion opening being constructed and arranged for receiving an insertion of a stabilizing piece through the T-shaped opening in the wrench head to stabilize the wrench in a use position.

7. The wrench of claim 6, wherein the movable portion of the handle is slidable along the axis to selectively extend the handle.

8. The wrench of claim 6, wherein the wrench is a pipe wrench.

9. A wrench storage system comprising:

at least one wrench, each wrench having:

a handle with a fixed portion and a movable portion, the movable portion being slidable through the handle by means of rotation of an adjustment wheel rotatable about an axis through the handle, and wherein an upper end of the handle forms a wrench head; a first clamping portion mounted to the handle;

a second clamping portion mounted to the movable portion, sliding of the movable portion causing relative movement between the first clamping portion and the second clamping portion toward or away from one another;

an insertion opening on an exterior surface of the wrench head; and a wrench storage portion for supporting the at least one wrench, the wrench storage portion being constructed and arranged for engagement with the insertion opening of each wrench, and comprising:

a base portion having a surface;

at least one connection portion for engagement with the insertion opening of each wrench, each connection portion attached to the base portion and projecting upwardly from the surface of the base, the connection portion extending longitudinally relative to the base portion; and an abutment portion for engagement with the wrench head of each wrench, the abutment portion aligned with each connection portion, the abutment portion attached to the base portion and projecting upwardly from the surface of the base, the abutment portion extending laterally across an end of the base portion.

10. The wrench storage system of claim 9, wherein at least one connection portion is T-shaped and at least one corresponding insertion portion is T-shaped.

* * * * *